US007104410B2

(12) United States Patent
Primiano

(10) Patent No.: US 7,104,410 B2
(45) **Date of Patent: *Sep. 12, 2006**

(54) DISPLAY TRACK DEVICE WITH ANTI-TORSION BAR

(75) Inventor: Bernard Primiano, Marietta, GA (US)

(73) Assignee: Display Industries, LLC., Norcross, GA (US)

( * ) Notice: Subject to any disclaimer, the term of this patent is extended or adjusted under 35 U.S.C. 154(b) by 264 days.

This patent is subject to a terminal disclaimer.

(21) Appl. No.: 10/375,588

(22) Filed: Feb. 27, 2003

(65) Prior Publication Data

US 2004/0084391 A1 May 6, 2004

Related U.S. Application Data

(63) Continuation-in-part of application No. 10/284,788, filed on Oct. 31, 2002, now Pat. No. 6,722,509.

(51) Int. Cl.
*A47F 1/04* (2006.01)

(52) U.S. Cl. ..... 211/59.2; 211/74; 211/183; 312/72

(58) Field of Classification Search ..... 211/59.2, 211/59.3, 74, 183, 175, 189; 312/45, 72
See application file for complete search history.

(56) References Cited

U.S. PATENT DOCUMENTS 4,109,980 A * 8/1978 Brockman et al. ..... 312/35
4,598,828 A * 7/1986 Young et al. ..... 211/59.2
4,792,051 A * 12/1988 Miller ..... 211/184
5,024,336 A 6/1991 Spamer
5,351,838 A 10/1994 Flum
5,634,564 A 6/1997 Spamer et al.
5,645,176 A 7/1997 Jay
5,904,256 A 5/1999 Jay
6,068,142 A * 5/2000 Primiano ..... 211/183
6,082,556 A 7/2000 Primiano et al.
6,142,316 A * 11/2000 Harbour et al. ..... 211/59.2
6,237,784 B1 5/2001 Primiano
6,325,221 B1 12/2001 Parham
6,523,702 B1 * 2/2003 Primiano et al. ..... 211/59.2
6,604,638 B1 * 8/2003 Primiano et al. ..... 211/59.2
6,615,995 B1 * 9/2003 Primiano et al. ..... 211/59.2
6,679,389 B1 * 1/2004 Robertson et al. ..... 211/59.2
6,695,152 B1 * 2/2004 Fabrizio et al. ..... 211/59.2
6,702,127 B1 * 3/2004 Primiano ..... 211/59.2
6,715,621 B1 * 4/2004 Boron ..... 211/59.2
6,722,509 B1 * 4/2004 Robertson et al. ..... 211/59.2

* cited by examiner

*Primary Examiner*—Gregory J. Strimbu
(74) *Attorney, Agent, or Firm*—John L. James

(57) ABSTRACT

A merchandising display shelf track device for receiving a row of articles for sliding movement therealong has non-planar front face members connected to a base wall and sidewalls. Racking forces exerted on the front face members are transferred through the non-planar face members to the base wall and sidewalls to minimize racking. An anti-torsion bar connects the front face members to prevent spreading of the sidewalls and thereby minimize racking.

5 Claims, 7 Drawing Sheets

DISPLAY TRACK DEVICE WITH ANTI-TORSION BAR

CROSS-REFERENCE TO RELATED APPLICATIONS

This application is a continuation-in-part of application Ser. No. 10/284,788 filed Oct. 31, 2002, now U.S. Pat. No. 6,722,509, and is related to application Ser. No. 10/095,277 filed Mar. 11, 2002, now U.S. Pat. No. 6,604,638, and application Ser. No. 10/350,438 filed Jan. 24, 2003, now U.S. Pat. No. 6,702,127.

TECHNICAL FIELD OF THE INVENTION

This invention relates to a track device for a merchandising display shelf, and, more particularly, to a gravity feed track device for articles on the shelf, particularly bottles, to slide along.

BACKGROUND OF THE INVENTION

A display rack unit is assembled from multiple track devices for merchandising articles such as bottled or canned drink products. The display rack unit may include a plurality of elongated track devices detachably interconnected in side-by-side relationship at adjacent sidewalls forming channels for beverage containers to slide along. It is common for adjacent channels to share a common sidewall to conserve space in the cooler. The number of track devices used to assemble the display rack unit is determined such that the overall size of the unit is suitable for placement onto an existing display shelf in a retail environment to fill the width of the shelf. A single retail installation for dispensing canned or bottled beverages can have hundreds of individual channels.

When manufacturing display track devices, cost is a factor, as well as appearance. To reduce material, and thereby material cost, adjacent tracks share a common sidewall, and the sidewalls as well as other members are formed with openings or voids. Sidewalls can be made thinner to conserve material, but thinner sidewalls tend to be flimsy which is undesirable. Strengthening ribs can be formed in the sidewalls to improve rigidity, but ribs effectively increase sidewall thickness thereby requiring more cooler space. The sidewalls, particularly at the front of the display track, have a tendency to spread apart. During use, a track device experiences forces that not only tend to cause the spreading of the sidewalls, but also causes racking the entire display track. Racking is the tendency of one component, which, when subjected to a force, to stress other components thereby distorting the display track causing the display track device to malfunction or break. Racking is a twisting of the structure. Increasing component thickness cures racking and spreading but is undesirable because the increased bulk increases manufacturing costs and lacks the desired aesthetics.

For the retail environment, not only are thinner walls desired, but an unobscured view of the product label in the display track as well. Such constraints have led to the use of an upper cross member at the top front of the track device to bridge the sidewalls or front structure. U.S. Pat. Nos. 6,325,221 (Parham), 6,237,784 (Primiano) and 5,645,176 (Jay) disclose track devices with a cross member.

The upper bridging cross member connects at each end to a sidewall or face panel to prevent spreading and reduce racking. Unfortunately, such cross members, when made with thin component thickness, are susceptible to breaking, with subsequent spreading. Accordingly, it will be appreciated that it would be highly desirable to have a display track device that conserves material and resists racking and spreading.

SUMMARY OF THE INVENTION

The present invention is directed to overcoming one or more of the problems set forth above. Briefly summarized, according to one aspect of the present the invention, a longitudinally extending base wall has first and second opposed side edge portions laterally spaced from one another and a front extension forming a bottom support for a lead article. A first upstanding sidewall has a bottom portion connected to the first side edge portion of the base wall, a top portion, and a front end portion extending between the top and bottom portions. A first face member has a top end portion, a bottom end portion and a longitudinal opening extending vertically between the top and bottom end portions. The first face member is connected to the front end portion of the first sidewall and to the base wall. The first face member extends laterally toward the second side edge portion. The first face member is laterally non-planar to increase racking resistance. A second face member upstanding from the second side edge portion of the base wall has a top end portion, a bottom end portion and a longitudinal opening extending vertically between the top and bottom end portions. The second face member extends laterally toward the first sidewall. The second face member is laterally non-planar to increase racking resistance. An anti-torsion bar connects the top end portions of the first and second face members.

Curving the face panels increases torsion resistance so that the lead article does not rack the track device when it contacts the stop members or face members. The curved panels increase structural strength so that thinner material can be used without compromising strength thereby allowing a more expensive material, such as polymethlmethacrylate for example, to be used without increasing cost. Providing an opening in the face members saves material without compromising structural integrity and racking resistance. A narrow bottom portion of the face members increases the viewing window making product identification easier. The anti-torsion bar connects the top portions of the face members and prevents the sidewalls from spreading and thereby retards racking.

According to another aspect of the invention, there is a second upstanding sidewall having a bottom portion connected to the second side edge portion of the base wall, a top portion, and a front end portion extending between the top and bottom portions. A second face member having a top end portion, a bottom end portion and a longitudinal opening extending vertically between the top and bottom end portions is connected to the front end portion of the second sidewall and to the base wall. The second face member extends laterally toward the first sidewall. The second face member is laterally non-planar to increase racking resistance. The anti-torsion bar connects the face members and prevents the sidewalls from spreading thereby preventing racking.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Referring to FIGS. 1 and 5–7, a merchandising display shelf track device 10 for receiving a row of articles for sliding movement therealong is illustrated. Such a track device is more fully illustrated and described in co-pending application Ser. No. 10/284,788 filed Oct. 31, 2002, now U.S. Pat. No. 6,722,509, the disclosure of which is incorporated herein by reference, A display rack unit is typically assembled from multiple track devices and is designed to merchandise articles such as bottled or canned beverage products. One common form of a display rack unit includes a plurality of elongated track devices detachably interconnected in side-by-side relationship. The exact number of track devices used to assemble the display rack unit is determined such that the size of the unit is suitable for placement onto an existing display shelf in a retail environment. The interconnection of two adjacent track devices is conventionally achieved by connecting means such as connector slots cooperating with L-shaped horizontal connector elements. Details of such track devices and connector elements are more fully described in U.S. Pat. No. 5,634,564, which issued Jun. 3, 1997 to Spamer et al., the disclosure of which is incorporated herein by reference.

The longitudinally extending base wall 12 has first and second opposed side edge portions laterally spaced from one another and front extension 16 forming a bottom support for the lead article. Preferably, front extension 16 is curved to fit the contour of the circumference of the container that it supports which is believed to be more aesthetically pleasing than a mismatch between the container and the extension. Of course, while a front extension that is dimensionally smaller than the container bottom would work, in practice, it is not practical because not every member of the consuming public is careful when removing a container from a display track device. While the container is easily removed by lifting, sometimes a consumer pushes downward on the container with sufficient force to rupture the container due to the mismatch between the container bottom and front extension. It is therefore desirable that the front extension be of larger diametrical dimension than the container to prevent rupture when a consumer pushes downward on the container.

Figure 5:
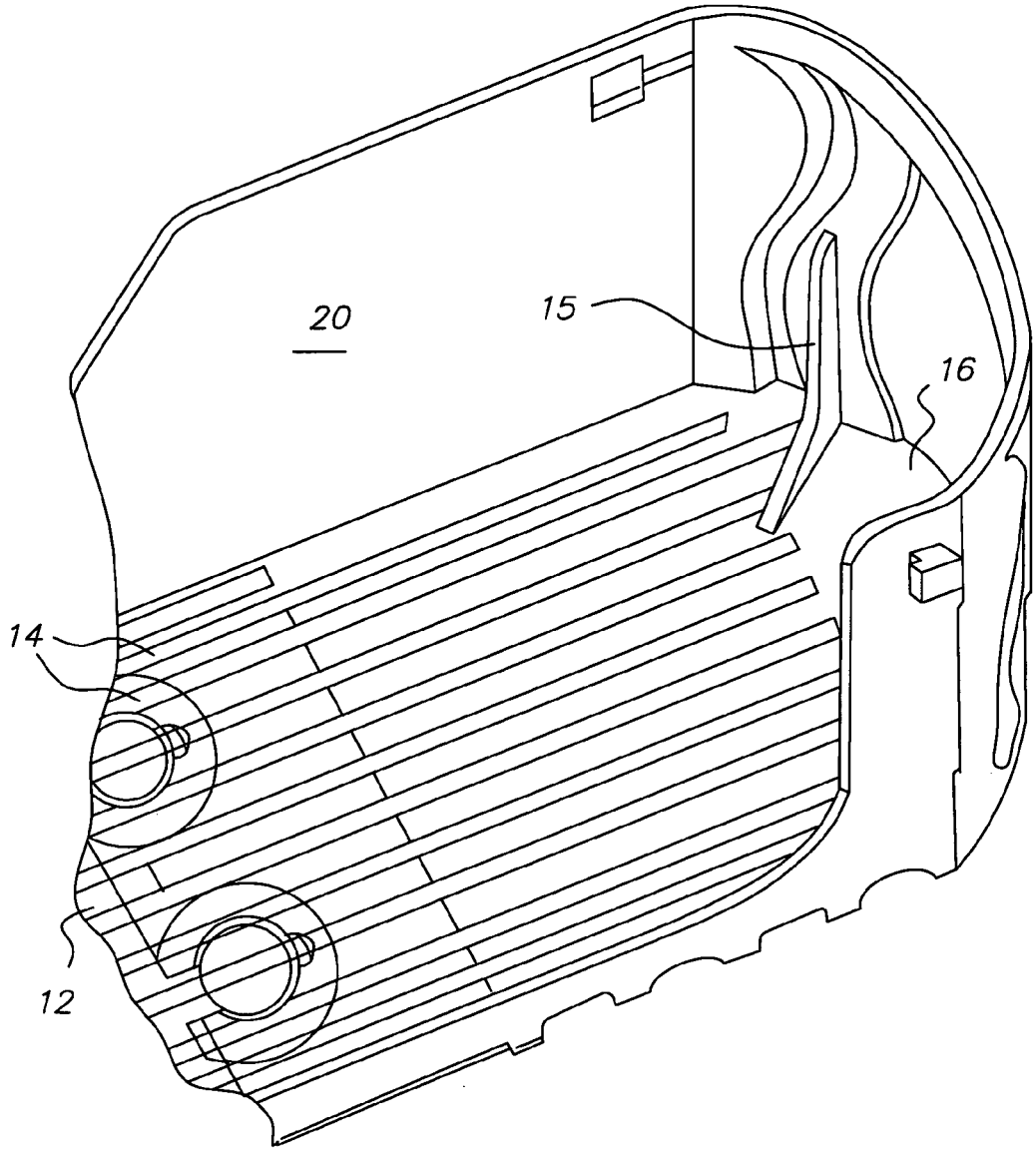
FIG. 5 is a perspective view of another preferred embodiment of a display track device, similar FIG. 1, incorporating rising ribs at the front.
Figure 6:
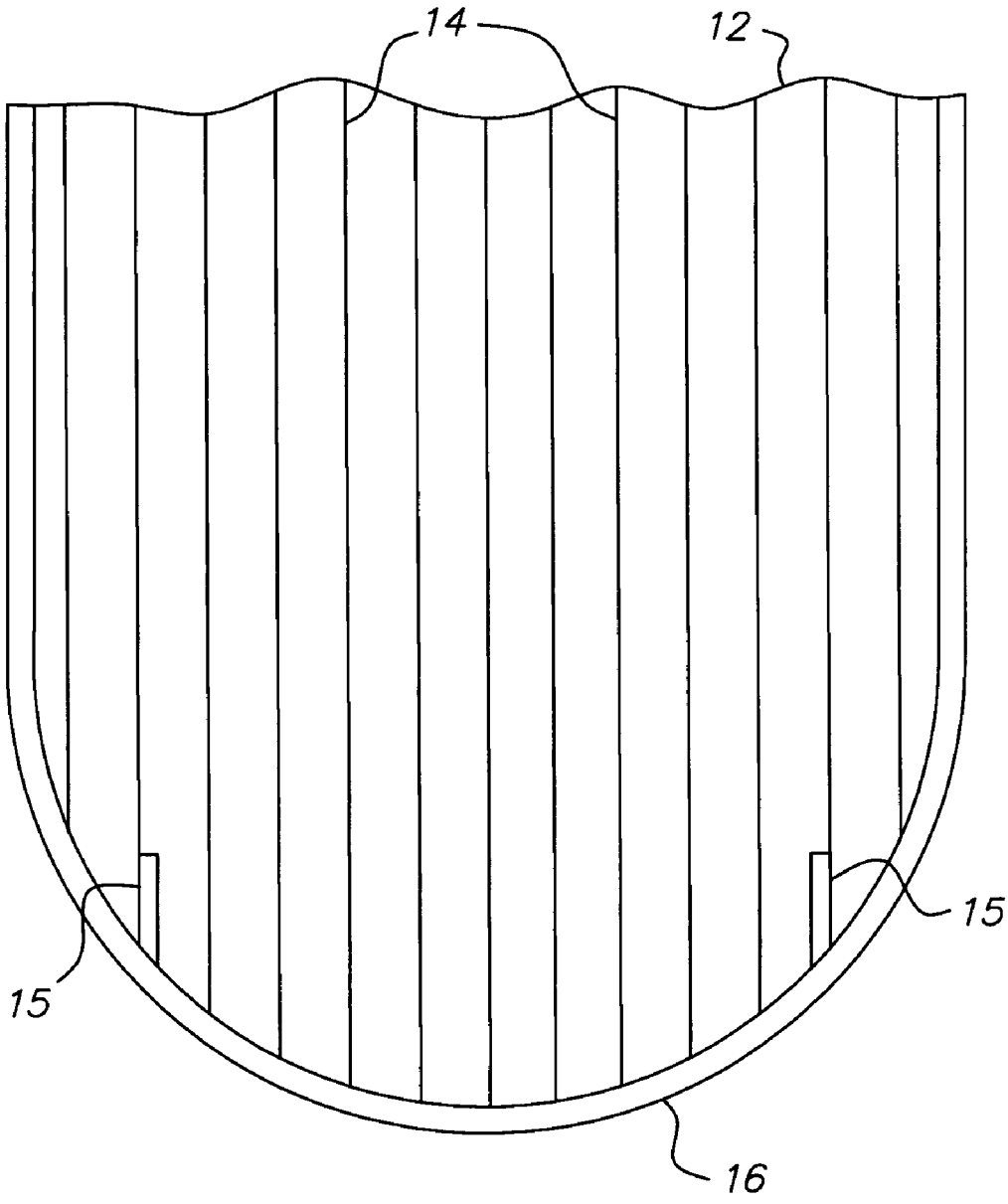
FIG. 6 is a diagrammatic top view of the display track device of FIG. 5.
Figure 7:
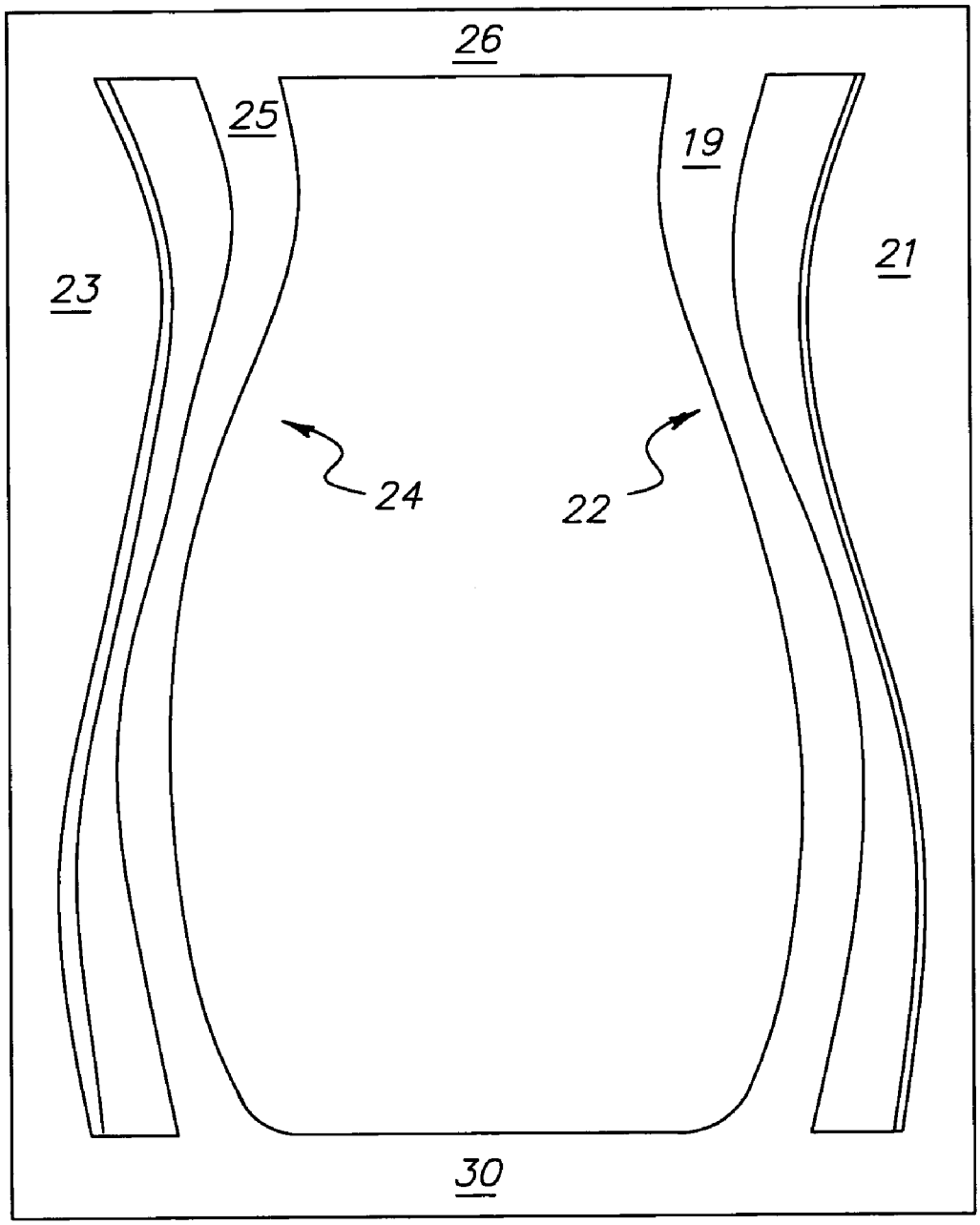
FIG. 7 is a front view of a display track device incorporating an anti-torsion bar according to the present invention.

Parallel ribs 14 are effective in reducing friction, however, sometimes friction is reduced to such an extent that the container develops too much downward speed for the structure which can cause tipping or other undesirable effects. To slow the downward speed, the number of parallel ribs may be reduced on the front extension or may be eliminated completely. Similarly, on the forward most portion of the base wall 12 behind the front extension 16, the number of friction reducing ribs is sometimes reduced or eliminated completely. Alternatively, some or all of parallel ribs 14 may have a riser panel or ramp 15 at the font to slow the downward speed (FIGS. 5 and 6). Such riser panels for reducing speed of an article sliding along the track are more fully described in application Ser. No. 10/095,277 filed Mar. 11, 2002, now U.S. Pat. No. 6,604,638, the disclosure of which is incorporated herein by reference.

Panels 15 may be arranged in pairs with one panel on either side of the longitudinal centerline of the track device. The front end of each panel 15 may be attached to a corresponding face panel and is preferably integrally formed with a rib and the face panel. Integral formation strengthens the structure and helps prevent racking.

A first upstanding sidewall 20 has a bottom portion connected to the first side edge portion of the base wall 12, and has a top portion. The first sidewall 20 also has a front end portion that extends between the top and bottom portions at the front of the sidewall and the track device.

A first face panel assembly 22 is connected to the first sidewall 20. Face panel assembly 22 has top and bottom end portions and is preferably connected, not only to the front end portion of sidewall 20, but to base wall 12, or, more preferably, the front extension 16 of base wall 12 as well. Face panel assembly 22 has a longitudinal opening extending vertically between the top and bottom end portions that divides face panel assembly 22 into left and right panels 19, 21. Left and right panels 19, 21 preferably define an S-shaped opening. First face panel 22 is connected to the front end portion of first sidewall 20 and to base wall 12. The first face panel assembly 22 extends laterally from sidewall 20 in a direction toward the second side edge portion of the base wall 12. The first face panel assembly 22 is laterally non-planar to increase racking resistance. By non-planar it is meant that the interior surface, and preferably the exterior surface, of face panel assembly 22 is not a flat panel but is curved. It may be formed of a number of contiguously interconnected flat panel sections or otherwise contoured to accommodate the configuration of a container placed therein. Being laterally non-planar means that, in the lateral direction which extends from one side edge or sidewall to the other, the interior surface of face panel assembly 22 departs from a line perpendicular to the side edges or sidewalls. In other words, when looking straight down on the structure, face panel assembly 22 is preferably arcuate relative to the perpendicular line.

By making face panel assembly 22 laterally non-planar, the torsional force required to twist the end portion of face panel assembly 22 is increased as well as the force required to bend face panel assembly 22 in the horizontal and transverse directions. In a three dimensional system, face panel assembly 22 has an X or transverse dimension, a Y or longitudinal dimension, and an Z or vertical dimension wherein one of the dimensions is zero. In the present invention, the dimensions of face panel assembly 22 can be considered as changing in the X and Y directions while remaining constant in the Z direction so that face panel assembly 22 resembles a curved room divider or wall panel sitting or standing on a floor that has its interior and exterior surfaces curved, but which does not curve in the vertical direction at all. Any curvature of face panel assembly 22 in the Z or vertical direction would change the relationship between the top and bottom stop members and is appropriate only when the relationship between the top and bottom stop members is taken into account.

Preferably, face panel assembly 22 has a larger lateral dimension along its top portion than along its bottom portion. Such construction halts forward motion of a container while maximizing a window for viewing product labeling. Dividing face panel assembly 22 into left and right panels 19, 21 tends to increase the viewing area, and, more importantly, to draw attention to the viewing area. While only one longitudinal opening is shown, there could be more than one opening to provide a central bridging member between the left and right panels 19, 21 to thereby increase torsional strength and racking resistance while reducing material.

A second face panel assembly 24 is upstanding from the second side edge portion of base wall 12. Second face panel assembly 24 has top and bottom end portions with the bottom end portion preferably connected to base wall 12. Face panel assembly 24 has a longitudinal opening extending vertically between the top and bottom end portions that divides face panel assembly 24 into left and right panels 23, 25. Left and right panels 23, 25 define a reverse S-shaped opening which is a mirror image of the opening defined by left and right panels 19, 21 of the first face panel assembly 22. Second face panel assembly 24 extends laterally a preselected distance towards first sidewall 20 and is also laterally non-planar to increase its racking resistance. When taken together, face panel assemblies 22 and 24 form an arc of a circle the diameter of which is slightly greater than the diameter of the container that slides along the track device. Because containers are designed to hold either a certain quantity of beverage and/or have certain physical dimensions, the diameter of a particular container can be ascertained. Accordingly, track devices can be manufactured for a particular container. The result is that there is not an infinite number of container diameters to consider. There is a finite number of container diameters to consider, so that only a relatively small number of curvatures of the face panel are required to accommodate most container dimensions.

In addition to forming an attractive front for the track device, the face panels are also functional. They halt the forward movement of the lead container in the track. As the containers are gravity fed from the rear of the track device toward the front, they experience acceleration and acquire speed and momentum. The center of gravity for a container does not lie on the bottom of the container but at some interior mid-portion of the container. To help keep the container from tipping over, along with the face panels, an anti-rotation bar 26 is provided.

Preferably, anti-torsion bar 26 lies above the center of gravity of the container but may lie below the center of gravity of the container depending upon whether the it is contacted first by the container, or whether a bottom stop member 30 is first contacted by the container. Bottom stop member 30 is preferably connected to the front extension 16 of the base wall but may be connected to the bottom end portions of the first and second face panels 22, 24 as well.

When bottom member 30 is first contacted by the container, forward momentum carries the center of gravity forward in a direction tending to tip over the container in which instance it is desirable to have the anti-torsion bar 26 above the center of gravity so that there is no danger of tipping. However, because the center of gravity of the container is in the interior space of the liquid filled container, the center of gravity shifts as the liquid moves. Because the center of gravity lies within the interior of the container, the anti-torsion bar may be positioned below the center of gravity without danger of the container tipping over. The exact vertical positioning of the anti-torsion bar is not only dependent on the center of gravity of the container as it slides down the track but also upon the particular configuration of the container. This is so because a beverage container is filled with liquid which shifts when the forward motion of the container ceases abruptly causing the center of gravity to shift.

The shift in the center of gravity, and therefore the tendency to tip over, depends upon the amount liquid, the amount of free space, and the configuration of the container. Thus, a container filled with a volume of liquid with air space above the liquid will experience a certain amount of shift in the center of gravity which can be taken into account when positioning the top stop members. It is desirable that the anti-torsion bar 26 not only prevent the container from tipping over but also prevent the container from lifting any portion of its bottom off the base wall. These constraints can be met when the anti-torsion bar is positioned above the center of gravity for the container and the containers do not experience free fall when sliding down the track. Anti-torsion bar 26 also prevents spreading of the face panels and therefore the sidewalls.

Preferably, the first and second face panels 22, 24 each have a larger lateral dimension along its bottom portion than along its top portion, not only for aesthetic appeal, but to prevent a container from being removed from the track device by its bottom. In conventional structures, removal by the bottom provides an opportunity for breaking the cross member joining the sidewalls causing the structure to rack and fail.

The anti-torsion bar 26 forms a continuous top cross member that bridges sidewalls or front structure of the display track device. Its function is to help halt forward motion of the lead container to prevent tipping and to prevent spreading. Because the anti-torsion bar is physically connected to the face members, it prevents the sidewalls, face panels or front structure of the track device from spreading. Because the non-planar configuration of the face members also acts an anti-torsion device that impedes torsional and racking forces exerted on either the anti-torsion bar or the bottom stop member when the lead container impacts them, it minimizes torsional and racking forces transferred through them. In effect, the non-planar configuration of the face members and their physical connection to the sidewalls, base wall and stop members enables them to absorb or distribute forces to thereby reduce racking, and the anti-torsion bar can be constructed of thin material.

Figure 3:
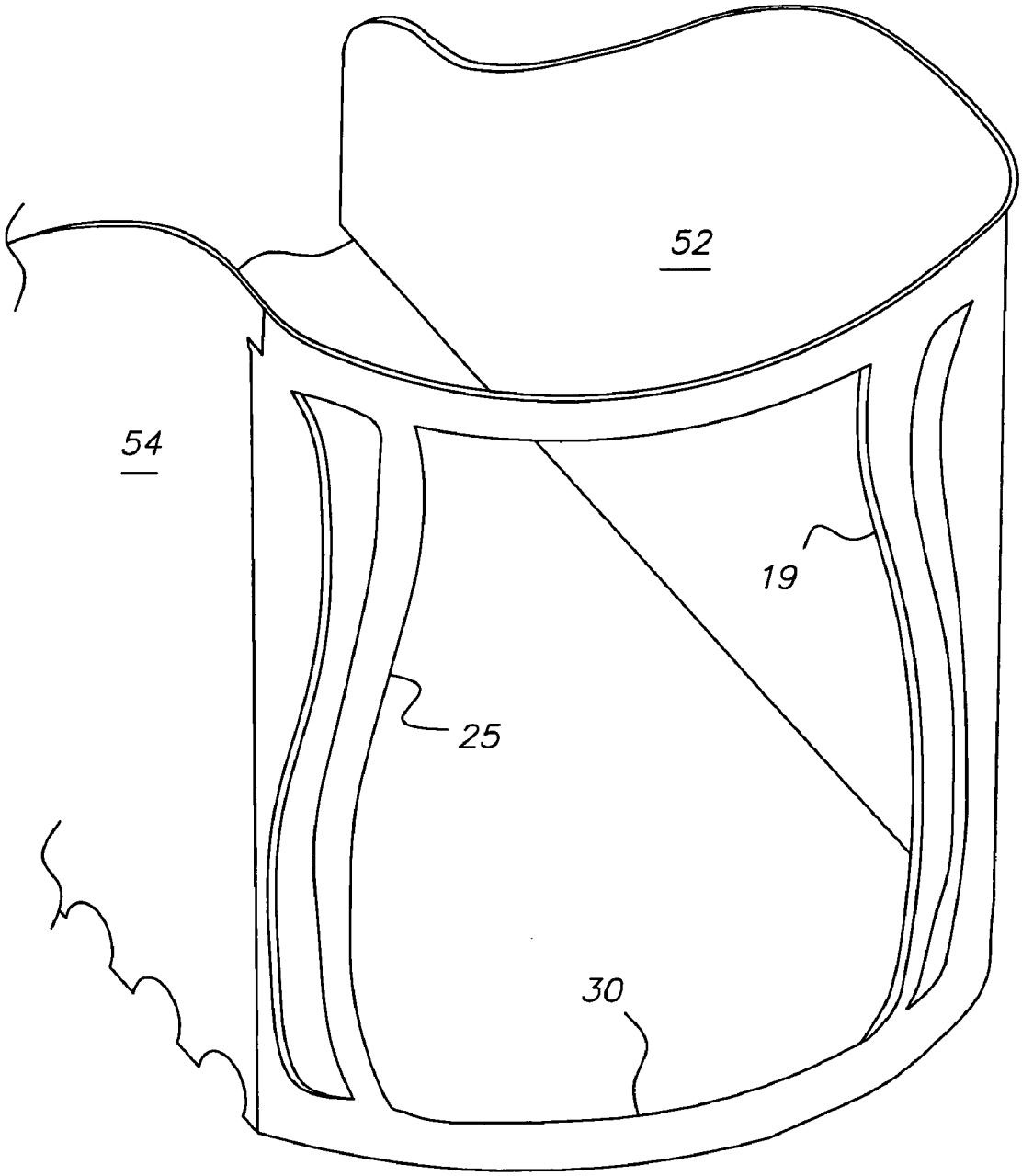
FIG. 3 is a perspective view similar to FIG. 1 but with two permanently attached sidewalls.
Figure 4:
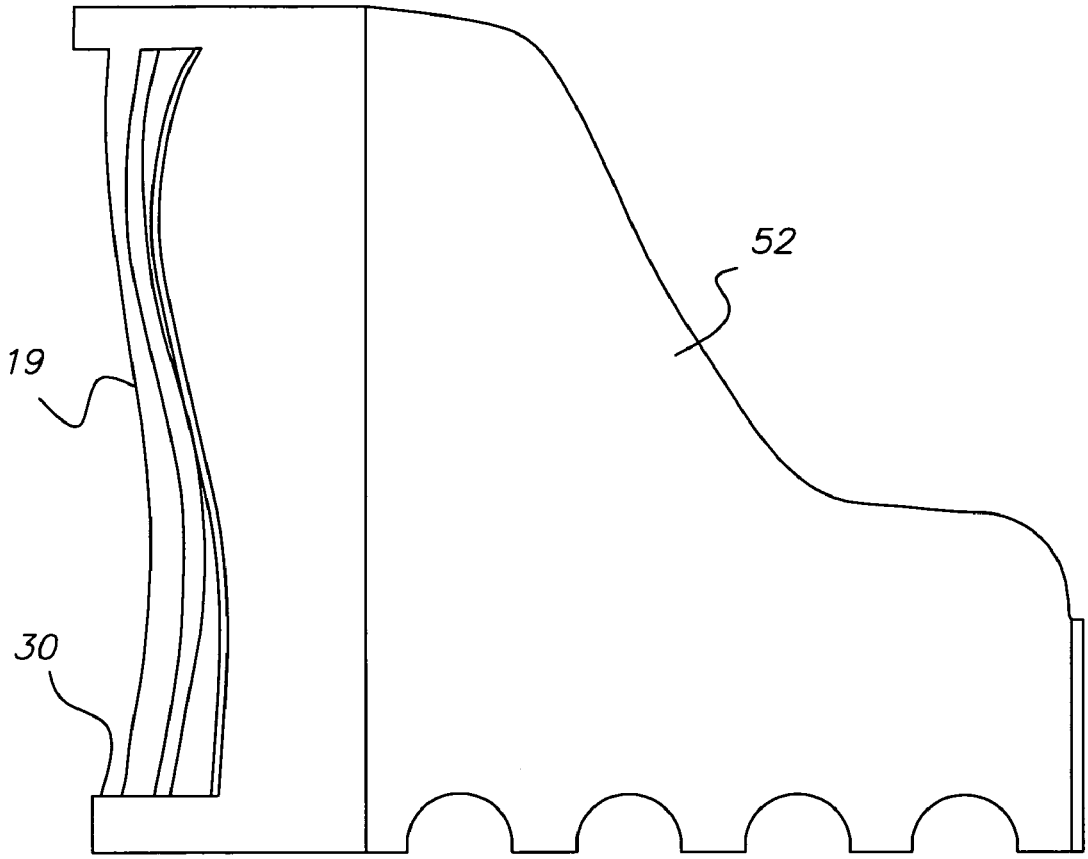
FIG. 4 is a right side view of the display track device of FIG. 3.

When a beverage container contacts the face members 22, 24, the axial or longitudinal force of the container results in an outward or transverse force tending to spread the face members and an axial or longitudinal force tending to stretch the face members along the longitudinal axis of the track. The curved structure of the face members resists torsion and transfers the force to the base wall to which they are connected. When filled with beverage containers, there is no possibility that the base wall will move or distort to cause racking. FIG. 3 illustrates front face members integrally formed with sidewalls of the track device forming a curvilinear structure that is of uniform wall thickness. The anti-torsion bar further reduces the possibility of racking.

Again referring to FIG. 1, the track device includes means for removably attaching a second sidewall which is preferably one or a plurality of L-shaped or T-shaped lugs 48 extending from the side of the second face member 24. The first face member 22 has openings 50 to receive lugs so that display track devices can bell connected side-by-side. Where there is only one track device, a sidewall can be attached to the track device using the lugs 48.

Figure 1:
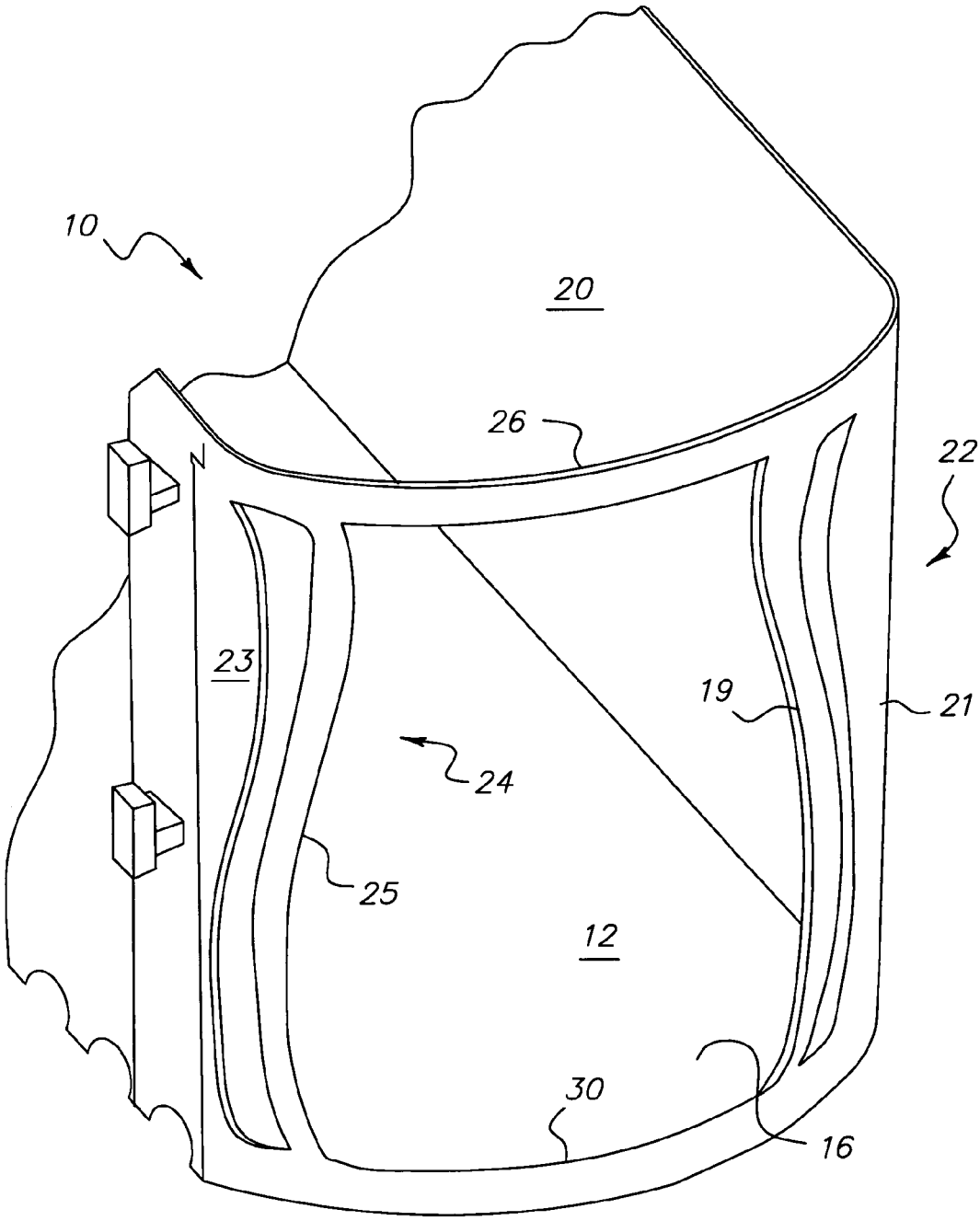
FIG. 1 is a perspective view of a preferred embodiment of a display track device incorporating an anti-torsion bar according to the present invention.
Figure 2:
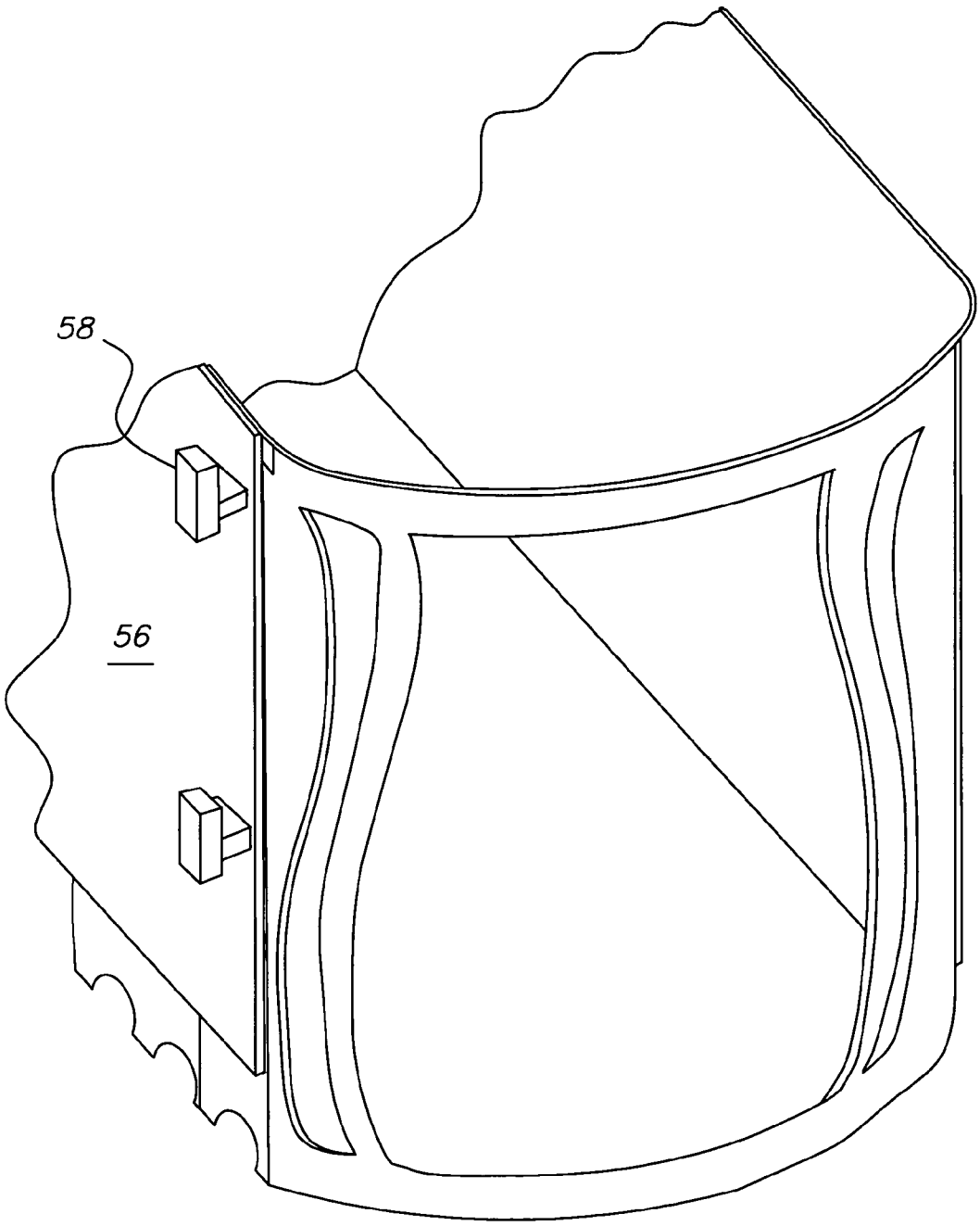
FIG. 2 is a perspective view similar to FIG. 1 but with a detachable sidewall attached.

FIG. 3 illustrates a display track device with two sidewalls 52, 54 permanently connected. This configuration allows different width track devices to be placed side by side on a shelf to accommodate different sizes of containers without assembly. They are simply placed next to one another on a shelf making them convenient to use for smaller coolers where several different products are displayed. The sidewalls 52, 54 are taller in the front of the track device than at the rear giving them a flowing contour that saves material and makes the beverage containers more visible in the track. FIG. 2 illustrates a display track device with a removable sidewall 56 attached by lugs 58.

It can now be appreciated that a merchandising display shelf track device has a non-planar columnar face panel that adds rigidity to the structure. When the anti-torsion bar is integrally formed with the columnar member that is attached to the base wall, particularly the front extension of the base member, the result is a structure that mimics an aircraft to resist racking. A force exerted against the anti-torsion bar in the direction of the longitudinal axis of the base member, and therefore the display track device, also acts against the columnar structure and the front extension of the base member. The effect is that the force is met with a much stiffer resistance than if the columnar member were not present or if the columnar member were planar. The result is less racking allowing the anti-torsion bar or the columnar structure to be constructed of thinner material.

Racking and fracture are very real problems that are somewhat addressed by reducing the number of friction reducing ribs at the front extension and front portion of the base wall so that the beverage container slows in both speed and acceleration as it nears the front stop members. When used, the riser panels also slow the speed of the beverage container as it nears the front stop members. In conventional structures, when a front cross member fractures or fails, partial disassembly of the structure is required and reassembly is necessary to replace broken components when possible, otherwise, the structure is ruined and must be replaced. The increased cost per pound of polycarbonate material over polypropylene or other commonly used materials is justified by the increased rigidity and clarity of the polycarbonate material. It is to be remembered that a driving force in changes in display track devices is reduced cost and ease of brand recognition by limiting the amount of structure that obscures both the product and the product labeling.

Again referring to the analogy between the structure and an aircraft, the structure can be likened to an aircraft wherein the tops of the face members mimics the wings of an aircraft, the columnar member mimic the fuselage of the aircraft, and the front extension of the base wall or the base wall itself mimics the tail section of the aircraft. In such an analogy, the racking of the top portion of the face members is inhibited by the connection of the columnar members to the base wall, just as the fuselage resists torsion between the wings and tail section of an aircraft. Also, the anti-torsion bar restricts movement of the face members. If the base member is considered stationary, which is generally the case because its movement is limited by the weight of the containers, then the racking movement of the top portions of the face members is limited also, and also limited by the anti-torsion bar.

While the invention has been described with particular reference to the preferred embodiments, it will be understood by those skilled in the art that various changes may be made and equivalents may be substituted for elements of the preferred embodiments without departing from invention. For example, while contoured sidewalls have been described with regard to fixed sidewalls, contours can be used with removable sidewalls as well.

As is evident from the foregoing description, certain aspects of the invention are not limited to the particular details of the examples illustrated, and it is therefore contemplated that other modifications and applications will occur to those skilled in the art. For example, while components are illustrated as solid, they could be perforated to conserve material and promote air circulation. It is accordingly intended that the claims shall cover all such modifications and applications as do not depart from the true spirit and scope of the invention.

What is claimed is:

1. A merchandising display shelf track device adapted to receive articles including a lead article for sliding movement therealong, comprising:

a longitudinally extending base wall having first and second opposed side edge portions laterally spaced from one another and a front extension forming a bottom support for said lead article;

a first upstanding sidewall having a bottom portion connected to said first side edge portion of said base wall, a top portion, and a front end portion extending between said top and bottom portions;

a first face member mounted on said base wall and extending from said base wall to said top portion of said first sidewall and having a top end portion, a bottom end portion and a longitudinal opening curvilinear along its length extending vertically between said top and bottom end portions of said first face member, said first face member being connected to said front end portion of said first sidewall, said first face member disposed vertically so that said top end portion of said first face member is contiguous with said top portion of said first upstanding sidewall, said first face member extending laterally toward said second side edge portion and forming a front stop member to halt forward sliding movement of said lead article, said first face member being laterally non-planar to increase racking resistance and rigidity thereof;

a second face member upstanding from said second side edge portion of said base wall and having a top end portion, a bottom end portion and a longitudinal opening extending vertically between said top and bottom end portions of said second face member, said second face member extending laterally toward said first sidewall forming an additional front stop member to halt the forward sliding movement of said lead article, said second face member being laterally non-planar to increase racking resistance and rigidity thereof; and an anti-torsion bar connecting said top end portions of said first and second face members.

2. A merchandising display shelf track device, as set forth in claim 1, wherein said first and second face members each have a larger lateral dimension along its top end portion than along its bottom end portion, said first and second face members each;

said base wall includes a plurality of ribs extending therealong, at least two ribs of said plurality of ribs each having a riser panel attached to a respective one of said first and second face members; and means for removably attaching a second sidewall to said second face member.

3. A merchandising display shelf track device, as set forth in claim 1, wherein said longitudinal opening of said first face member divides said first face member into left and right panels, and wherein said longitudinal opening of said second face member divides said second face member into left and right panels.

4. A merchandising display shelf track device, as set forth in claim 1, including:

a second merchandising display shelf track device; and means for connecting said merchandising display shelf track devices in a side by side relation.

5. A merchandising display shelf track device, as set forth in claim 4, wherein said connecting means connects merchandising display shelf track devices along sidewalls thereof.

* * * * *